United States Patent [19]

Van Heijst

[11] 4,031,582

[45] June 28, 1977

[54] FLOATING STRUCTURE

[75] Inventor: Willem J. Van Heijst, Monte Carlo, Monaco

[73] Assignee: N.V. Industrieele Handelscombinatie Holland, Rotterdam, Netherlands

[22] Filed: Mar. 9, 1976

[21] Appl. No.: 665,333

[30] Foreign Application Priority Data

Mar. 10, 1975 Netherlands ..... 74.02829

[52] U.S. Cl. ..... 9/8 P

[51] Int. Cl.² ..... B63B 21/52

[58] Field of Search ..... 9/8 R, 8 P; 114/230 SF

[56] References Cited

UNITED STATES PATENTS

| | | | |
|---|---|---|---|
| 3,479,673 | 11/1969 | Manning | 9/8 P |
| 3,883,912 | 5/1975 | Pedersen | 9/8 P |
| 3,916,812 | 11/1975 | Bartels | 9/8 P |

*Primary Examiner*—Trygve M. Blix
*Assistant Examiner*—Jesus D. Sotelo
*Attorney, Agent, or Firm*—Young & Thompson

[57] ABSTRACT

A floating structure useful as a mooring device for vessels, comprises an anchor having a rigid arm pivotally interconnected therewith and upstanding therefrom. The rigid arm at its upper end has a pivot about a horizontal axis and also a pivot 360° about a vertical axis by which a float is interconnected to the rigid arm for vertical and horizontal swinging movement relative to the rigid arm. The float may directly overlie the rigid arm, in which case a further rigid arm extends laterally from the float to the vessel or to a further float which in turn is connected to the vessel. Alternatively, the float may be laterally offset from the rigid arm and connected thereto on one side by its own rigid arm and on the other side to the vessel by a further arm rigid with the float and pivotally connected to the vessel.

4 Claims, 4 Drawing Figures

FLOATING STRUCTURE

The invention relates to a floating structure with floats of which one by means of a rigid arm hingedly around a horizontal axis is coupled with another smaller float, which assembly of floats via a vertical tension loaded connection is coupled with an anchor, which assembly can turn 360° around the axis of said connection.

Such a device may consist of an assembly of three floats, namely, a vessel, a float directly above the anchor and connected with said anchor and a third float, which engages a rigid arm, said arm being hingedly coupled with the vessel as well as with the float which has been connected with the anchor.

With said prior proposal one aims at obtaining a mooring device which is inexpensive, easily and quickly can be placed and replaced and which has a great stability.

Further study of this subject now has discovered that improvements are possible.

These improvements in the first place are achieved in that the assembly has two floats, of which one is at least essentially below water level. Hereby it is achieved that the vertical force upon the anchor is constant.

According to the invention the connection with the anchor consists of a torsion-stiff rod or tube which by means of a hinge with perpendicular intercrossing or intersecting axes, such as a cardan-hinge, has been connected to the anchor, which connection at the upper end of it via a second corresponding hinge connection has been connected with the assembly of floats.

Hereby it is obtained that the floating structure has a security of which the number of degrees of latitude has been limited to those which are necessary for having the structure turn 360° around a vertical axis and to allow deviations of the rod with respect to the true vertical position. This provides the structure with a very stable position.

The most suitable embodiment is obtained if the second hinge has been connected to an arm, said arm rigidly being connected to a float under water and directed away from it in a direction opposite to that of the rigid arm between the two floats.

However, it is also possible to couple said second hinge directly to the float under water or with the rigid arm between both floats.

It will be clear that in all these cases there is still a connection with a vertical axis of rotation near the first or the second hinge.

According to the invention it is of further advantage if the second hinge is at a higher level than the horizontal hinge axis of the rigid arm between the two floats.

Hereby it is achieved that the horizontal forces, which are exerted by the sea upon the assembly of floats and the connection with the anchor, are more smoothly taken up.

The assembly of floats will generally consist of a relatively large float and a float which is small with respect thereto, which small float has been connected with the anchor. Said large float is preferably provided in a way known per se as a float with a small water intersecting surface. If hoses are applied then said hoses can be positioned in a known manner via the hinges or around the hinges and guided or supported via the rod or tube.

If the second hinge is directly coupled with the second float then said float preferably consists of two bodies at a distance from each other and the hinge is embodied in the elements which connect said bodies with each other or with the rigid arm respectively.

The invention now will be elucidated with reference to the drawings.

FIG. 1 schematically shows a first embodiment of the mooring device according to the invention.

Figure 1:
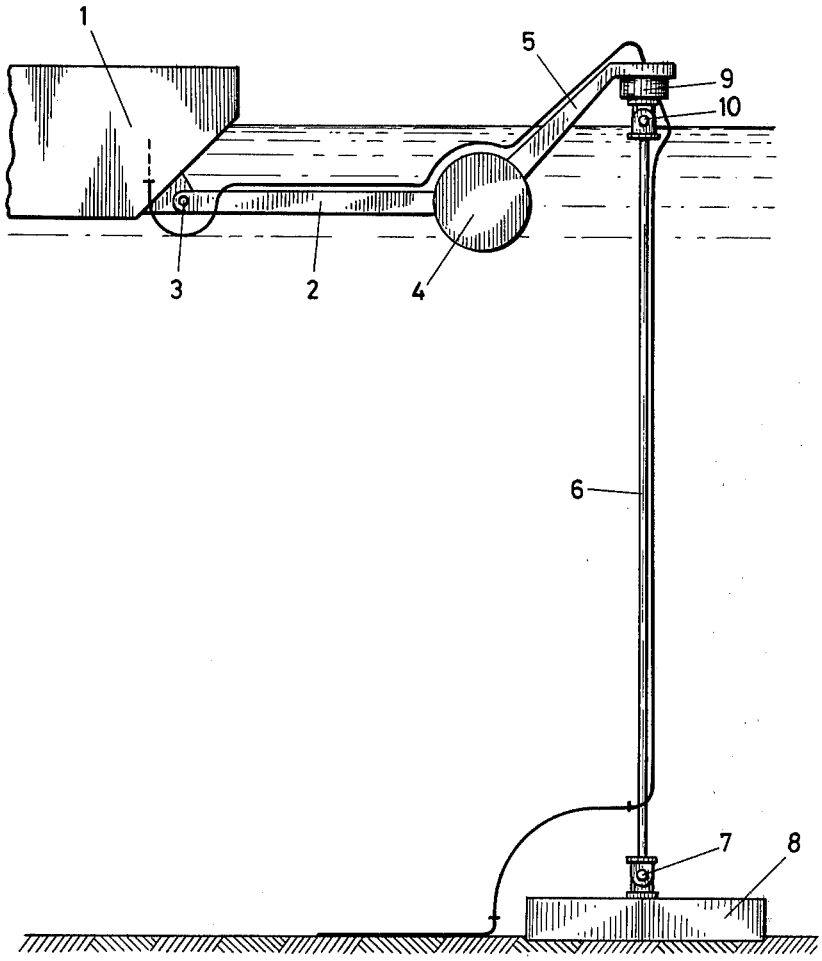
Figure 2:
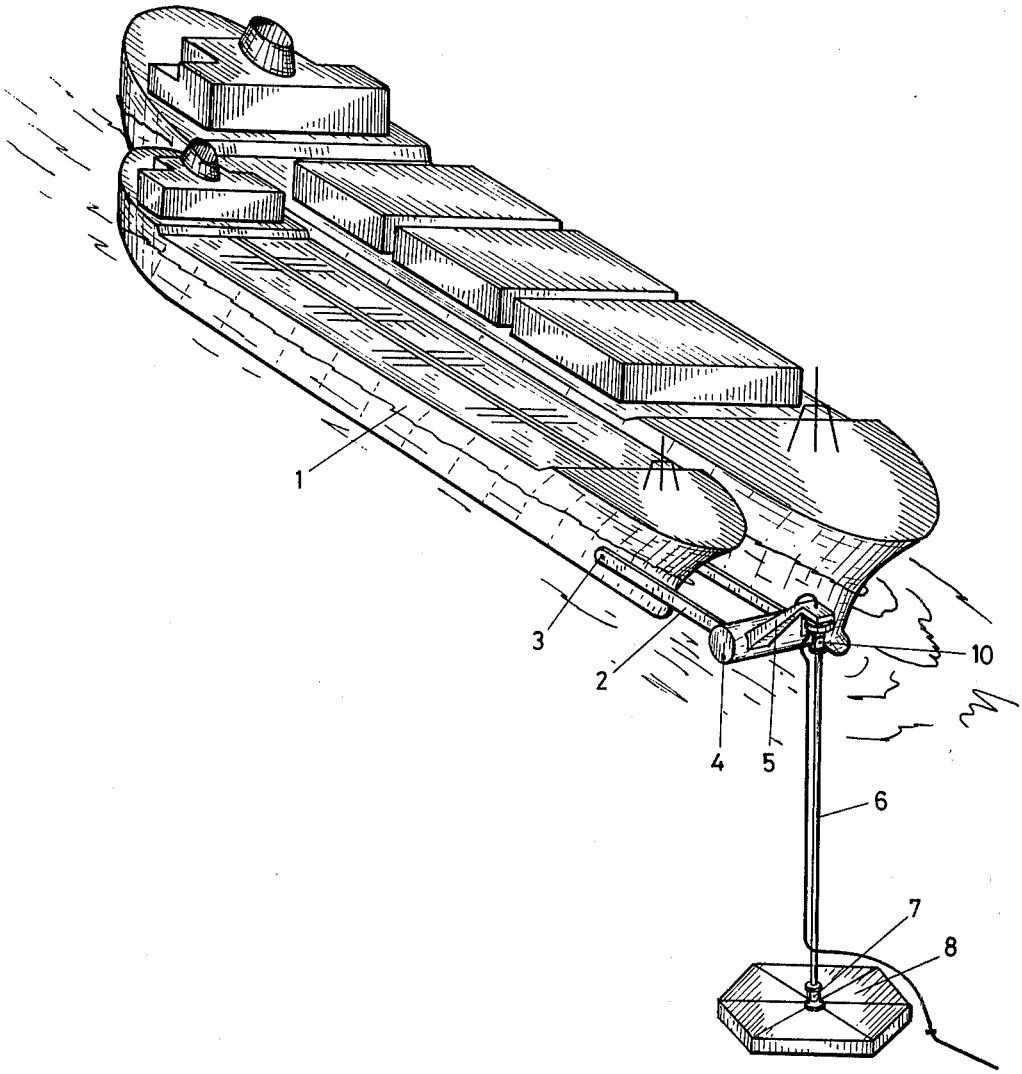
FIG. 2 shows the device according to FIG. 1 in perspective view.

The device shown in FIG. 1 consists of a vessel 1, which at 3 hingedly is coupled via a rigid arm 2 with a float 4, which is under water and which has been provided with a rigid arm 5 on which the rod 6 pulls, which at 7 by means of a cardan-hinge is connected with the anchor 8. The upper end of the rod 6 is at 10 connected to the outer end of the arm 5 via a cardan connection and a connection with a vertical axis of rotation 9.

Figure 3:
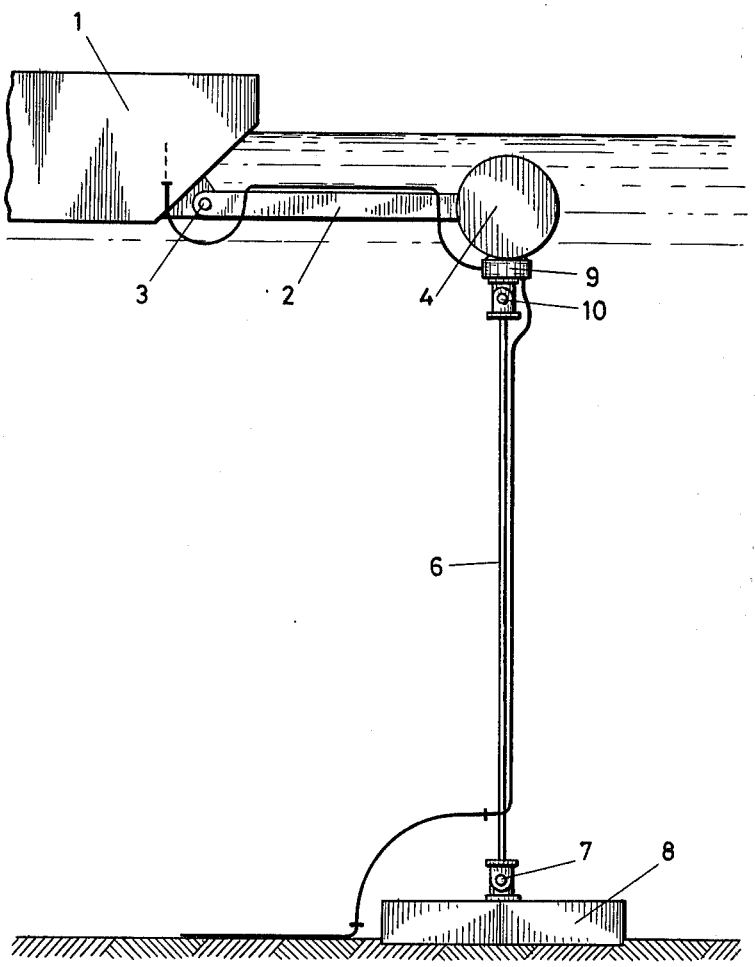
FIG. 3 shows a second embodiment.

The embodiment of FIG. 3 differs from the embodiment of FIG. 1 in that the rod 6 is directly coupled with the float 4 via a hinge connection of the type as indicated with 9, 10 in FIG. 1.

Figure 4:
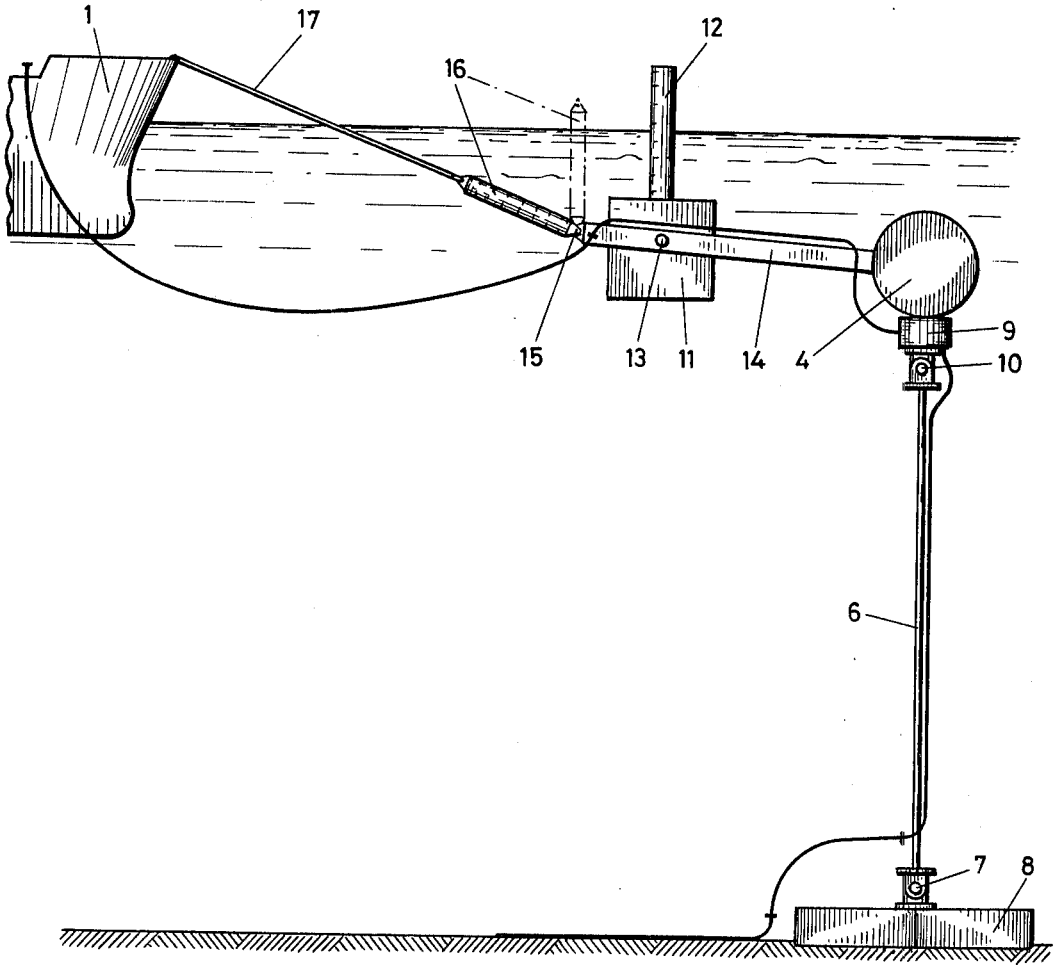
FIG. 4 shows a third embodiment.

The device of FIG. 4 consists of a float 11 which intersects the water-level with a narrow portion 12 and which is coupled via a rigid arm 14, hingedly connected therewith at 13, with a cylinder-shaped float 4, on which the rod 6 pulls, which is connected with the anchor.

At the outer end of the arm 14, that interconnects both floats, a rigid frame 16 has been hingedly mounted at 15, which frame via a cable 17 can be connected with the vessel. Said frame 16 is preferably constructed so that it tapers to the outer end and has adjustable buoyancy, so that it can be raised into the position indicated with interrupted lines. This position is favourable for coupling an anchor line. In this embodiment the vessel is directly coupled with the float, pulling at the anchor, and only a little acts upon the position of the float 11.

What is claimed is:

1. Floating structure comprising a large floating body intersecting the water-level, a small submerged float connected with said body by means of a rigid arm, said arm having a rigid connection with the small float and a pivotal connection about only a horizontal pivot axis with the floating body, said small float further being connected with an anchor by means of a torsion-stiff tube or rod having a hinge with perpendicularly intercrossing or intersecting axes between the lower end of the tube or rod and the anchor as well as between the upper end of the tube or rod and the said small float, said last mentioned connection further having a vertical axis of rotation between the small float and the upper hinge.

2. Floating structure according to claim 1, characterized in that the upper hinge is connected to a rigid arm rigidly connected to the small float and directed away from it in a direction opposite to that of the rigid arm between the large float and the small float.

3. Floating structure according to claim 3, characterized in that the last-mentioned hinge is located at a higher level than the horizontal pivot axis between the first-mentioned rigid arm and the large floating body.

4. Floating structure according to claim 4, characterized in that the rigid arm between the small float and the upper hinge extends upwardly from the small float to the upper hinge.

* * * * *

UNITED STATES PATENT AND TRADEMARK OFFICE

CERTIFICATE OF CORRECTION

PATENT NO. : 4,031,582

DATED : June 28, 1977

INVENTOR(S) : Willem J. VAN HEIJST

It is certified that error appears in the above-identified patent and that said Letters Patent are hereby corrected as shown below:

In item [30], the Foreign Application Priority Data, change "74.02829" to --75.02829--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*